US005139547A

United States Patent [19]

Agrawal et al.

[11] Patent Number: 5,139,547

[45] Date of Patent: * Aug. 18, 1992

[54] PRODUCTION OF LIQUID NITROGEN USING LIQUEFIED NATURAL GAS AS SOLE REFRIGERANT

[75] Inventors: Rakesh Agrawal, Allentown; Calvin L. Ayres, New Tripoli, both of Pa.

[73] Assignee: Air Products and Chemicals, Inc., Allentown, Pa.

[ * ] Notice: The portion of the term of this patent subsequent to Aug. 11, 2009 has been disclaimed.

[21] Appl. No.: 691,771

[22] Filed: Apr. 26, 1991

[51] Int. Cl.[5] ..... F25J 1/00; F25J 1/02

[52] U.S. Cl. ..... 62/8; 62/9; 62/40

[58] Field of Search ..... 62/8, 9, 40, 24, 13, 62/30

[56] References Cited

U.S. PATENT DOCUMENTS

| | | | |
|---|---|---|---|
| 3,857,251 | 12/1974 | Alleaume | 62/28 |
| 3,886,758 | 6/1975 | Perrotin et al. | 62/30 |
| 4,054,433 | 10/1977 | Buffiere | 62/13 |
| 4,192,662 | 3/1980 | Ogata et al. | 62/13 |
| 4,211,544 | 7/1980 | Springmann | 62/40 X |
| 4,437,312 | 3/1984 | Newton et al. | 62/50.2 X |
| 4,582,519 | 4/1986 | Someya et al. | 62/9 X |
| 4,638,639 | 1/1987 | Marshall et al. | 62/9 |
| 4,894,076 | 1/1990 | Dobracki et al. | 62/9 |

FOREIGN PATENT DOCUMENTS

| | | |
|---|---|---|
| 0304355 | 2/1989 | European Pat. Off. . |
| 2307004 | 8/1974 | Fed. Rep. of Germany . |
| 46-20123 | 6/1971 | Japan . |
| 52-37596 | 3/1977 | Japan . |
| 53-15993 | 5/1978 | Japan . |
| 58-150786 | 9/1983 | Japan . |
| 1376678 | 12/1974 | United Kingdom . |
| 1520581 | 8/1978 | United Kingdom . |

OTHER PUBLICATIONS

Yamanouchi et al., Chem. Engr. Progress, Jul. 1979.

*Primary Examiner*—Henry A. Bennet
*Assistant Examiner*—Christopher B. Kilner
*Attorney, Agent, or Firm*—Willard Jones, II; William F. Marsh; James C. Simmons

[57] ABSTRACT

The present invention relates to a process for liquefaction of a nitrogen stream produced by a cryogenic air separation unit. Cold liquid natural gas (LNG) is employed as refrigerant.

A critical feature step of the invention is that the temperature of the vaporizing LNG should be maintained at a temperature lower than the critical temperature of the nitrogen stream being liquefied.

The process involves compressing the nitrogen stream to at least 350 psi in a multistage compressor wherein interstage cooling is provided by heat exchange against vaporizing LNG. Further cooling and flashing of a portion of the liquid nitrogen stream serves to produce a quantity of liquid nitrogen that is free of hydrocarbon contamination and suitable for recycle to the air separation unit.

7 Claims, 3 Drawing Sheets

LP GAN
HP GAN FROM ASU
NATURAL GAS
TO/FROM HOT WATER SYSTEM
HP GAN FROM ASU
LNG
HP GAN
LP GAN
LIN
BOIL-OFF VAPOR FROM LIN STORAGE
LIN TO STORAGE
PURGE

BOIL-OFF VAPOR FROM LIN STORAGE
LP GAN FROM ASU
HP GAN FROM ASU
NATURAL GAS
TO/FROM HOT WATER SYSTEM
HP GAN FROM ASU
LNG
HP GAN
LIN
LP GAN
90A
96A
103A
104A
106A
100A
102A
98A
160A
112A
146A
110A
148A
150A
156A
154A
166A
190A
162A
192A
92A
94A
144A
138A
126A
120A
142A
136A
124A
108A

PRODUCTION OF LIQUID NITROGEN USING LIQUEFIED NATURAL GAS AS SOLE REFRIGERANT

TECHNICAL FIELD OF THE INVENTION

The present invention relates to a process for liquefaction of nitrogen produced by separating air by cryogenic distillation using an improved refrigeration source, particularly, vaporizing LNG, to yield the liquefied nitrogen.

BACKGROUND OF THE INVENTION

The separation of air to produce oxygen, nitrogen, argon, and other materials is done by distillation under low pressure to achieve power conservation. It is known that the refrigeration available from liquefied natural gas (LNG) can be utilized for cooling feed air and/or compressing component gases.

When pipelines are not feasible, natural gas is typically liquefied and shipped as a bulk liquid. At the receiving port, this liquefied natural gas (LNG) must be vaporized and heated to ambient temperatures. An efficient use of this refrigeration at the time of vaporization is highly desirable. It is becoming more common to build air separation plants with liquefiers which utilize the refrigeration available from the vaporizing LNG. An efficient scheme, which more effectively utilizes the refrigeration available from LNG to produce liquid products from air, can lead to substantial savings in energy and capital investment.

Several publications disclose the production of liquid nitrogen by indirect heat exchange against vaporizing LNG. Since the coldest temperature of LNG is typically above −260° F., the nitrogen must be at a pressure greater than ambient pressure in order to be condensed because the normal boiling point of nitrogen is −320° F. Typically, to condense at temperatures of about −260° F., the nitrogen must be compressed to above 225 psia. Compression of the nitrogen prior to its condensation by heat exchange with LNG is one of the major sources of energy consumption in producing a liquid nitrogen product.

U.S. Pat. No. 3,886,758 discloses a method wherein a nitrogen stream is compressed to a pressure of about 15 atm (221 psia) and then condensed by heat exchange against vaporizing LNG. Since all the gaseous nitrogen is not precooled against the warming natural gas prior to compression, the amount of energy required for the nitrogen compressor is quite high.

U.K. patent application 1,520,581 discloses a process of using the excess refrigeration capacity associated with a natural gas liquefaction plant to produce additional LNG, specifically for the purpose of providing refrigeration for the liquefaction of nitrogen In the process, the nitrogen gas from the air separation plant to be liquefied is compressed without any precooling with LNG.

Yamanouchi and Nagasawa (Chemical Eng. Progress, pp. 78, July 1979) describe another method of using LNG refrigeration for air separation. Once again, nitrogen at about 5.2 atm is compressed to about 31 atm without any precooling. Moreover, in this paper, LNG is vaporized in the LNG heat exchanger at close to ambient pressure (15 psia).

U.K. patent 1,376,678 teaches that evaporation of LNG at close to atmospheric pressure is inefficient because the vaporized natural gas must be admitted into a distribution pipeline at a pressure at which it can reach its destination, i.e., a transport pressure This transport pressure is much higher than atmospheric pressure usually not exceeding 70 atm (1029 psi). Therefore, if LNG is vaporized at atmospheric pressure, then a considerable amount of energy is required to recompress the vaporized gas to its transport pressure As a result, in U.K. patent 1,376,678, the LNG is first pumped to the desired pressure and then vaporized. Unfortunately, the process of refrigeration energy recovery taught in this patent is inefficient because not all of the refrigeration available from the LNG is recovered and the vaporized natural gas leaving the LNG heat exchanger is still quite cold (−165° F.) This incomplete recovery of refrigeration implies that, for this process, large quantities of LNG will be required to produce the desired quantity of liquid nitrogen (LIN).

Japanese patent publication 52-37596 (1977) teaches vaporizing low pressure LNG against an elevated pressure nitrogen stream, which is obtained directly from a distillation column which operates at an elevated pressure. In the process, only part of the LNG is vaporized against the condensing nitrogen and the remainder of the LNG is vaporized in the other heat exchangers; this is an inefficient use of the refrigeration energy of LNG. The vaporized natural gas is then compressed.

U.S. Pat. No. 3,857,251 discloses a process for producing liquid nitrogen by extraction of nitrogen from the vapors resulting from the evaporation of LNG in storage tanks. The gaseous nitrogen is compressed in a multistage compressor with interstage cooling provided by water, air, propane, ammonia, or fluorocarbons.

Japanese patent publication 46-20123 (1971) teaches cold compression of a nitrogen stream which has been cooled by vaporizing LNG. Only a single stage of nitrogen compression is used. As a result, an effective use of LNG cold energy, which vaporizes over a wide range of temperature, is not obtained.

Japanese patent publication 53-15993 (1978) teaches the use of LNG refrigeration for the high pressure nitrogen drawn off the high pressure column of a double column air distillation system The nitrogen is cold compressed in a multistage compressor, but without any interstage cooling with LNG.

German patent 2,307,004 describes a method for recovering LNG refrigeration to produce LIN. Nitrogen gas from the warm end of a cryogenic air separation plant is close to ambient pressure and ambient temperature. This feed nitrogen is compressed, without any LNG cooling, in a multistage compressor. A portion of this compressed gas is partially cooled against LNG and expanded in an expander to create low level refrigeration. The other portion of compressed nitrogen is cold compressed and condensed by heat exchange against the expanded nitrogen stream. The expanded gas is warmed and recompressed to an intermediate pressure and then fed to the nitrogen feed compressor operating with an inlet temperature close to ambient. It is clear that most of the nitrogen compression duty is provided in compressors with inlet temperature close to ambient temperature and that no interstage cooling with LNG is provided in these compressors.

U.S. Pat. Nos. 4,054,433 and 4,192,662 teach methods whereby a closed loop, recirculating fluid is used to transfer refrigeration from the vaporizing LNG to a condensing nitrogen stream In U.S. Pat. No. 4,054,433, a mixture of methane, nitrogen, ethane or ethylene and $C_3+$ is used to balance the cooling curves in the heat exchangers. The gaseous nitrogen from the high pressure column (pressure≈6.2 atm) is liquefied without any further compression. However, a large fraction of nitrogen is produced at close to ambient pressure from a conventional double column air distillation apparatus. Its efficient liquefaction would require a method to practically compress this nitrogen stream, which is not suggested in this U.S. patent.

In U.S. Pat. No. 4,192,662, fluorocarbons are used as recirculating fluid wherein it is cooled against a portion of the vaporizing LNG and then used to cool low to medium pressure nitrogen streams. This scheme presents some problems and/or inefficiencies Energy losses due to fluorocarbon recirculation are large; requiring additional heat exchangers and a pump. Furthermore, the use of fluorocarbons has negative environmental implications and use of alternate fluids are expensive.

Japanese patent publication 58-150786 (1983) and European patent application 0304355-A1, (1989) teach the use of an inert gas recycle such as nitrogen or argon to transfer refrigeration from the LNG to an air separation unit. In this scheme, the high pressure inert stream is liquefied with natural gas, and then revaporized in a recycle heat exchanger to cool a lower pressure inert recycle stream from the air separation unit. This cooled lower temperature inert recycle stream is cold compressed and a portion of it is mixed with the warm vaporized high pressure nitrogen stream. The mixed stream is liquefied against LNG and fed to the air separation unit to provide the needed refrigeration and then returned from air separation unit as warm lower pressure recycle stream. Another portion of the cold compressed stream is liquefied with heat exchange against LNG and forms the stream to be vaporized in the recycle heat exchanger. These schemes are inefficient. For example, all of the recirculating fluids are cold compressed in a compressor with no interstage cooling with LNG.

BRIEF SUMMARY OF THE INVENTION

According to this invention, a process is taught for the liquefaction of a nitrogen stream which is normally generated in a cryogenic air separation unit having at least one distillation column. The process comprises compressing the input gaseous nitrogen streams from the air separation unit to a pressure of at least 350 psi in a multi-stage compressor wherein interstage cooling is provided by heat exchange against a vaporizing liquefied natural gas (LNG), serving as sole refrigerant. The compressed nitrogen stream is condensed by heat exchange against the vaporizing LNG, followed by reducing the pressure of the condensed compressed nitrogen stream, thereby producing a two-phase nitrogen stream. The two-phase nitrogen stream undergoes phase separation into a first liquid nitrogen stream and a first nitrogen vapor stream, the warming of the latter serving to recover refrigeration.

In a preferred embodiment, further subcooling of the condensed nitrogen stream is effected prior to reducing the pressure of the condensed nitrogen stream by heat exchange against the warmed nitrogen vapor stream. In another embodiment, the warmed nitrogen vapor stream is recycled to an intermediate stage of the multi-stage compressor. In still another embodiment, the foregoing described reduction in pressure of the condensed compressed nitrogen stream is accomplished by work expanding such condensed stream in a dense fluid expander.

In a final embodiment of the first embodiment, a portion of the first liquid nitrogen stream is flashed and then heat exchanged against a pressurized nitrogen stream, thereby producing a quantity of liquid nitrogen which is free from hydrocarbon contamination. This liquid nitrogen is suitable for recycle to the air separation unit for production of liquid oxygen.

In yet another embodiment, the phase separated liquid nitrogen stream is further subcooled for reducing the pressure of subcooled nitrogen stream, thereby producing a second two-phase nitrogen stream, with the latter being subjected to phase separation into second nitrogen vapor and liquid product streams, including subcooling the first liquid nitrogen stream against the warming second nitrogen vapor stream.

This invention is applicable to liquefaction of other component gases such as argon, as well as the preferred nitrogen. These gases can either be directly cooled using the scheme of this invention, or already liquefied nitrogen could be vaporized to provide liquid oxygen and/or liquid argon. A gas stream comprised of oxygen, argon and nitrogen could also be liquefied by this process.

Important aspects of the present process are the avoidance of using a recirculating fluid, like fluorocarbons, thereby simplifying the piping and heat exchange equipment, as well as obviating the costs of such recirculating fluid and the frequent attended negative environmental hazards, i.e., atmospheric ozone layer deterioration. An optional feature is including a dense fluid expander means to provide some added refrigeration to the high pressure, cold component (nitrogen) product take-off stream For example, a portion of liquid nitrogen is taken from the first separator and is flashed in a second separator, with the resulting liquid nitrogen being sent to product storage. Nitrogen vapor from the second separator serves to cool the other compressed nitrogen streams.

DETAILED DESCRIPTION OF THE INVENTION

Figure 1:
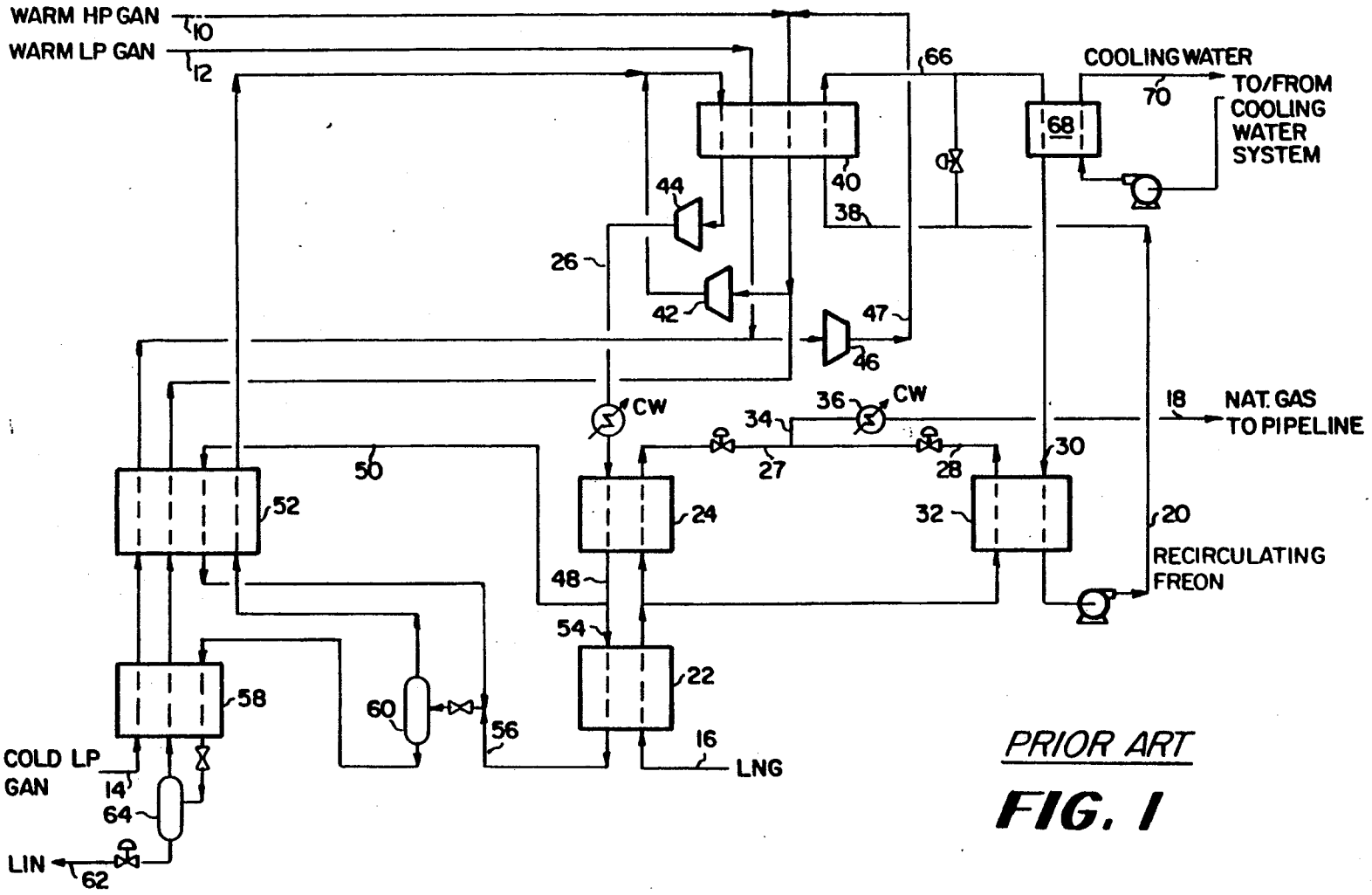
PRIOR ART FIG. 1
FIG. 1 is a general schematic flow diagram of a state-of-the-art process for the generation of liquefied air products components from cryogenic air separation components which recovers refrigeration from LNG and employs a fluorocarbon as the recirculating fluid.

Referring now to the drawing, and, in particular, to FIG. 1, a process flowsheet is shown for the cryogenic process taught in U.S. Pat. No. 4,192,622; the process uses a fluorocarbon (Freon TM) as a recirculating fluid to recover refrigeration from a vaporizing LNG source. In the process, warm high pressure gaseous nitrogen stream 10, and a warm low pressure gaseous nitrogen stream 12 from the air separation unit (not shown) are introduced into the liquefier. Also introduced into the liquefaction system are cold low pressure gaseous nitrogen stream 14, as well as refrigerant LNG feed stream 16, which finally exits as a pressurized natural gas stream 18 to a gas pipeline (not shown). The recirculating fluid flows only through closed loop 20, with provision being made (not shown) for its recharging due to losses.

Refrigerant LNG 16 flows sequentially through heat exchangers 22 and 24, against a twice-compressed (once-precooled) high pressure gaseous nitrogen stream 26 (initially drawn from streams 10 and 12), emerging as a warm refrigerant stream 27. This natural gas stream 27 combines with partly warmed side stream 28, which has separately provided refrigeration to the warmed fluorocarbon stream 30 in heat exchanger 32 to produce natural gas stream 34. Combined warmed natural gas stream 34 passes through heat exchanger 36 and is recovered as pipeline transportable natural gas product, via stream 18.

Recirculating fluorocarbon stream 38 is used to refrigerate nitrogen streams 10 and 12, counterpassing in heat exchanger 40. Herein, these inlet nitrogen streams (10 and 12) are precooled and then cold compressed; stream 10 is sequentially compressed in compressors 42 and 44; stream ]2, after being cooled in heat exchanger 40, is compressed separately in cold compressor 46; and stream 47 is recycled to incoming high pressure gaseous nitrogen stream 10. Main cold compressed component stream 26 is further cooled by LNG in exchanger 24.

A portion of cooled nitrogen stream 48 passes directly, as stream 50, through heat exchanger 52, wherein it is cooled by the incoming cold low pressure gaseous nitrogen stream 14. The balance of cooled nitrogen stream 48 passes as stream 54 through sequential exchanger 22 to be further cooled, and, as stream 56, it is then reduced in pressure and passes through heat exchanger 58 after phase separation in separator 60. In heat exchanger 58, the liquid is subcooled by the cold low pressure gaseous nitrogen inlet stream 14 and then flashed, forming liquid nitrogen product stream 62.

In the process, a fluorocarbon is used because heat exchanging high pressure LNG (greater than 500 psi) with low pressure nitrogen streams in adjoining passages, of a heat exchanger, is deemed unsafe If a leak was to occur in these heat exchanger passages, the hydrocarbons of the LNG would contaminate the liquid nitrogen product leaving final phase separator 64 as stream 62. If such contaminated liquid nitrogen is then partly fed as a reflux to the low pressure column of the air separation unit (not shown), a safety hazard would exist. These contained hydrocarbons will migrate down the low pressure column and accumulate in the liquid oxygen at the bottom of the low pressure column creating a flammable mixture As a safety precaution, a fluorocarbon is used to minimize this hazard Additionally, none of the nitrogen streams having a pressure less than the LNG pressure are fed into primary heat exchangers 22 or 24 for recovery of the refrigeration in the LNG feed As detailed earlier, the recirculating fluid configuration presents its own problems and energy inefficiencies. These are the large energy losses due to fluorocarbon recirculation which require additional and sizeable heat exchangers and a pump. The process of the present invention avoids reliance on recirculating fluid, and more fully utilizes the refrigeration available in the LNG. The present invention is set out in the following embodiments.

The process of this invention will now be described in a preferred embodiment, in detail, with respect to liquefaction of nitrogen obtained from a cryogenic air separation unit. Although any air separation unit is applicable for use in the present invention, the air separation unit detailed in the following description is a conventional, double-column air distillation process. The details of such a process can be found in a paper by R. E. Latimer, "Distillation of Air" Chemical Engineering Progress, pp. 35–39, February, 1967.

Figure 2:
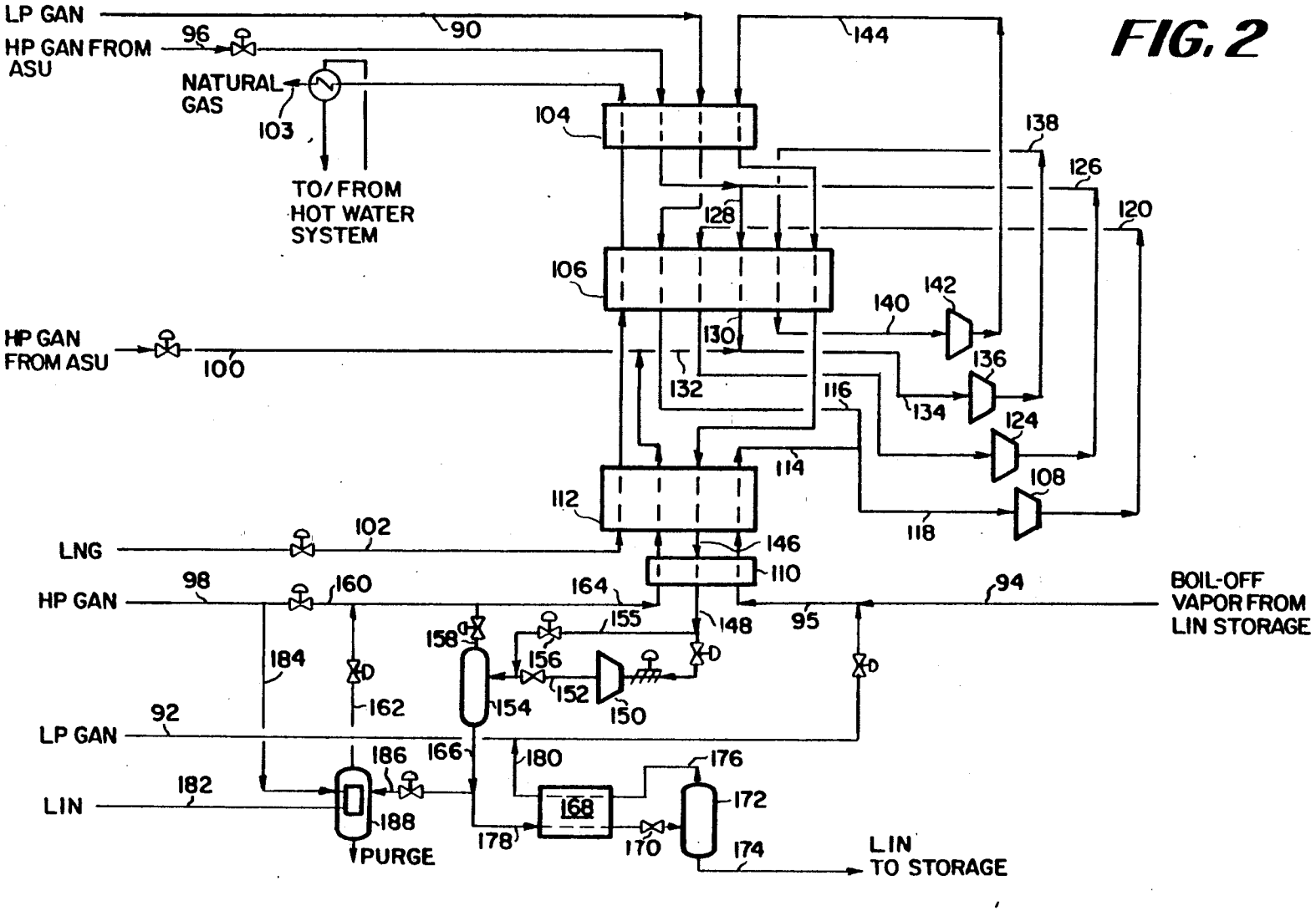
FIG. 2 is a specific flow diagram of one particular embodiment of the present cryogenic process for liquefying the rectified component products of an air separation unit of the present invention.

FIG. 2 depicts a schematic of the process of the present invention directed to nitrogen as the product component being liquefied. In the process, nitrogen to be liquefied is supplied from the air separation unit (not seen) as multiple high pressure and low pressure streams. The high pressure nitrogen stream comes from the high pressure column (not seen), operating at pressures greater than 75 psia, and the low pressure nitrogen is obtained from the lower pressure column (not seen), operating at pressures slightly above ambient pressure These streams are supplied as warm (close to ambient temperature) and cold streams (less than −120° F.) to the liquefier system. This is done to balance the cooling curves of the heat exchangers used in the air separation unit.

Low pressure gaseous nitrogen is supplied at close to ambient temperature as stream 90, while stream 92 supplies low pressure gaseous nitrogen at temperatures between −250° F. to −320° F. Optionally, boil off vapor from a liquid nitrogen storage tank (not seen) is fed as side stream 94. Some of the high pressure nitrogen is supplied at close to ambient temperature as stream 96; some nitrogen is supplied at the high pressure distillation column temperature as stream 98, and the rest of the nitrogen, stream 100, is supplied at a middle temperature lying between the ambient and the high pressure distillation column temperatures. Refrigerant LNG to be vaporized is provided via line 102. Typically, the pressure of incoming LNG stream 102 is between 100 psi and 1200 psi, so that the vaporized LNG, stream 103, can be sent (still at well over ambient pressure) directly to the pipeline distribution system, without further compression.

Low pressure gaseous nitrogen stream 90 is first cooled with LNG in heat exchangers 104 and 106 and then fed to first stage, compressor 108. Cold low pressure nitrogen stream 92 is combined with nitrogen stream 180 from heat exchanger 168 and then combined with nitrogen stream 94 to form stream 95, which is used to condense and subcool highest pressure entering gaseous nitrogen stream 146 in heat exchangers 110 and 112. Slightly warmed nitrogen stream 114 is first mixed with cooled low pressure nitrogen stream 116 to form combined nitrogen stream 118; combined nitrogen stream 118 forms the feed to the first stage cold compressor 108. Nitrogen stream 118 is compressed to a pressure such that the temperature of the boosted nitrogen stream 120 is colder than ambient temperature. Typically, this temperature is in the range between −100° F. to ambient temperature. Boosted nitrogen stream 120 is again cooled by heat exchange with the vaporizing LNG in heat exchanger 106 to provide cold stream 122, which is fed to second stage cold compressor 124. The discharge from compressor 124 is high pressure nitrogen stream 126, which is at a pressure similar to the high pressure distillation column pressure of the air separation unit (i.e., 75 psia to 200 psia).

High pressure nitrogen stream 126 is then mixed with high pressure precooled nitrogen stream 96, and resulting combined stream 128 is cooled in heat exchanger 106 to provide cooled high pressure nitrogen stream 130.

In FIG. 2, it is postulated that the temperature of high pressure internal nitrogen stream 126 is colder than that of high pressure inlet gaseous nitrogen stream 96. Therefore, stream 96 is slightly cooled in heat exchanger 104, prior to mixing with internal stream 126, to form combined stream 128. Further cooled high pressure internal nitrogen stream 130 is mixed with cold nitrogen stream 132 to provide another combined high pressure nitrogen stream 134. Combined nitrogen stream 134 is then cold compressed in third stage cold compressor 136 to produce medium pressure nitrogen stream 138. Stream 138 is once again cooled in heat exchanger 106 and then fed as stream 140 to the fourth stage cold compressor 142 to produce highest pressure nitrogen stream 144. The pressure of highly compressed stream 144 is in the range between 350 and 1500 psi, and, typically, is in the range between 600 and 1200 psi.

Due to LNG intercooling, the inlet stream temperatures to all four compressors will be below the ambient temperature. Typically, this temperature will be in the range between −50° F. and −260° F., and more preferably from −90° F. to −220° F. Thus, the highest pressure combined nitrogen stream 144 is uniquely obtained from lower pressure nitrogen streams 90, 92, 94, 96, 98 and 100 by multistage compression with interstage precooling with refrigerant LNG. The flowrate of lower pressure nitrogen feed streams 90, 92, 94, 96, 98 and 100 can be in any relative amounts to the extent that the flowrates of some of these streams can be even zero.

Highest pressure nitrogen stream 144 is again cooled in heat exchangers 104 and 106 against LNG, and further in heat exchanger 112 against LNG and the returning cold gaseous nitrogen streams such as 164, to provide subcooled stream 146. The temperature of liquid stream 146 is below the critical temperature of nitrogen. This stream is further subcooled in the downstream heat exchanger 110 to obtain cold highest pressure nitrogen stream 148. The pressure of this stream is decreased to an intermediate liquid nitrogen pressure range (typically 75 psi to 200 psi) by feeding it to a dense fluid expander 150 This nearly isentropic work expansion of the nitrogen stream makes the process more efficient. Exhaust stream 152 can be further reduced in pressure across a valve. Vapor and liquid are separated in phase separator 154.

Alternatively, cold highest pressure nitrogen stream 148 can bypass dense fluid expander 150, as stream 155, and its pressure could be reduced across valve 156, prior being fed to separator 154. The pressure in separator 154 is similar to the pressure of high pressure incoming gaseous nitrogen stream 98 (typically 75 psi to 200 psi). Vapor stream 158 from separator 154 is mixed with the rest of the cold high pressure nitrogen streams 160 and 162 and sent back to heat exchanger 110 as stream ]64 for further processing, as described earlier.

The majority of high pressure liquid nitrogen stream 166 from the separator 154 is subcooled in heat exchanger 168, then reduced in pressure across an isenthalpic valve 170, and fed to separator 172.

Liquid nitrogen product stream 174 from separator 172 is sent to a storage tank (not seen), and is therefore at the pressure of the storage tank. Typically, this pressure is within 5 psi of the ambient pressure. Nitrogen vapor 176 from separator 172 is used to subcool the liquid nitrogen feed to separator 172 in heat exchanger 168. Gaseous nitrogen stream 180 from heat exchanger 168 is mixed with incoming low pressure gaseous nitrogen stream 92 and recycled for compression and liquefaction, as described earlier. Liquid nitrogen product flows from the system via stream 182.

In the flow diagram shown in FIG. 2, liquid nitrogen stream 182 returning to the air separation unit is indirectly derived from the liquid nitrogen recovered from separator 154. For this purpose, a portion of high pressure inlet nitrogen stream 184 is condensed against a portion of liquid nitrogen stream 186 in reboiler/condenser 188. Condensed liquid nitrogen side stream 182 is sent to the distillation column system (not seen). Vaporized nitrogen overhead stream 162 is either sent totally to heat exchanger 110, as shown, or a portion of stream 162 can be sent to the heat exchangers (not shown) of the air separation unit.

According to the present invention, an energy efficient process is provided which is particularly adapted to recover refrigeration from LNG being vaporized for pipeline introduction. This obviates the known inefficiencies associated with recirculating fluorocarbon and its ancillary equipment. By interstage cooling with LNG of the successive component compression steps, the inlet volume of the air component feed is reduced. This keeps the size of the compression equipment small and reduces capital costs. As LNG is composed of several hydrocarbon elements which vaporize at different temperatures, this fosters high heat capacities of the vaporizing LNG over a comparatively wide temperature range. The process effectively utilizes the LNG refrigeration still available at above −180° F. by cooling of the lower pressure stream 90, along with the highest pressure stream 96, in the upstream exchangers 104 and 106, all being serviced with inlet LNG refrigerant.

The heat generated by staged cold compression somewhat heats component streams 120, 126, 138 and 144 which are cooled in exchangers 104 and 106. Because of the recooling of these streams after each compression stage (four are preferably employed), the temperature of the natural gas from upper exchanger 104 is considerably higher. This approach more fully utilizes the refrigeration available from the LNG.

As noted, in order to condense nitrogen, for example, entering the disclosed system at temperatures in the range of −200° F. to −260° F., the nitrogen must be compressed at a considerably higher pressure. As taught here, nitrogen is precooled prior to each compression stage, which substantially reduces energy consumption. The inventive process more effectively utilizes cold energy stored in refrigerant LNG, and produces liquefied air components with low energy consumption.

EXAMPLE

Trial sample calculations were done and it was found that the preferred process of FIG. 2 can produce liquid nitrogen with a power consumption of about 180–200 KWH/T of liquid nitrogen, as compared to 450–500 KWH/T of liquid nitrogen for conventional plants, which do not use any LNG refrigeration. For these calculations, about 0.4 equivalent tons of liquid nitrogen per ton of refrigerant LNG used was produced. The power use data include the power that would be consumed by the air separation unit to produce gaseous nitrogen in addition to the power for the liquefier. Clearly, the process of FIG. 2 is quite efficient.

There are alternate embodiments to the process shown in FIG. 2; these alternate embodiments are as follows:

With reference to FIG. 2, even though cold compressors 108, 124, 136 and 142 are shown to have their inlet streams come out of main heat exchanger 106 at the same place, i.e., all the streams to be cold compressed are cooled to the same temperature in heat exchanger 106; it may not be the most optimum way to do so. One could withdraw precooled streams from exchanger 106 at different temperatures for cold compression, in order to better match the cooling curves in heat exchangers and minimize the corresponding energy losses.

Furthermore, for convenience, in FIG. 2, these compressors have been shown as being separate compressors, but they could just as well be interstages of a single compressor (not shown).

Also, in FIG. 2, high pressure gaseous nitrogen side stream 184 from the air separation unit to be condensed in the boiler/condenser 188 could be cold compressed prior to condensation such that the vaporized nitrogen stream 162 could be at higher pressure, e.g., at about the same pressure as inlet high pressure gaseous nitrogen stream 98.

Figure 3:
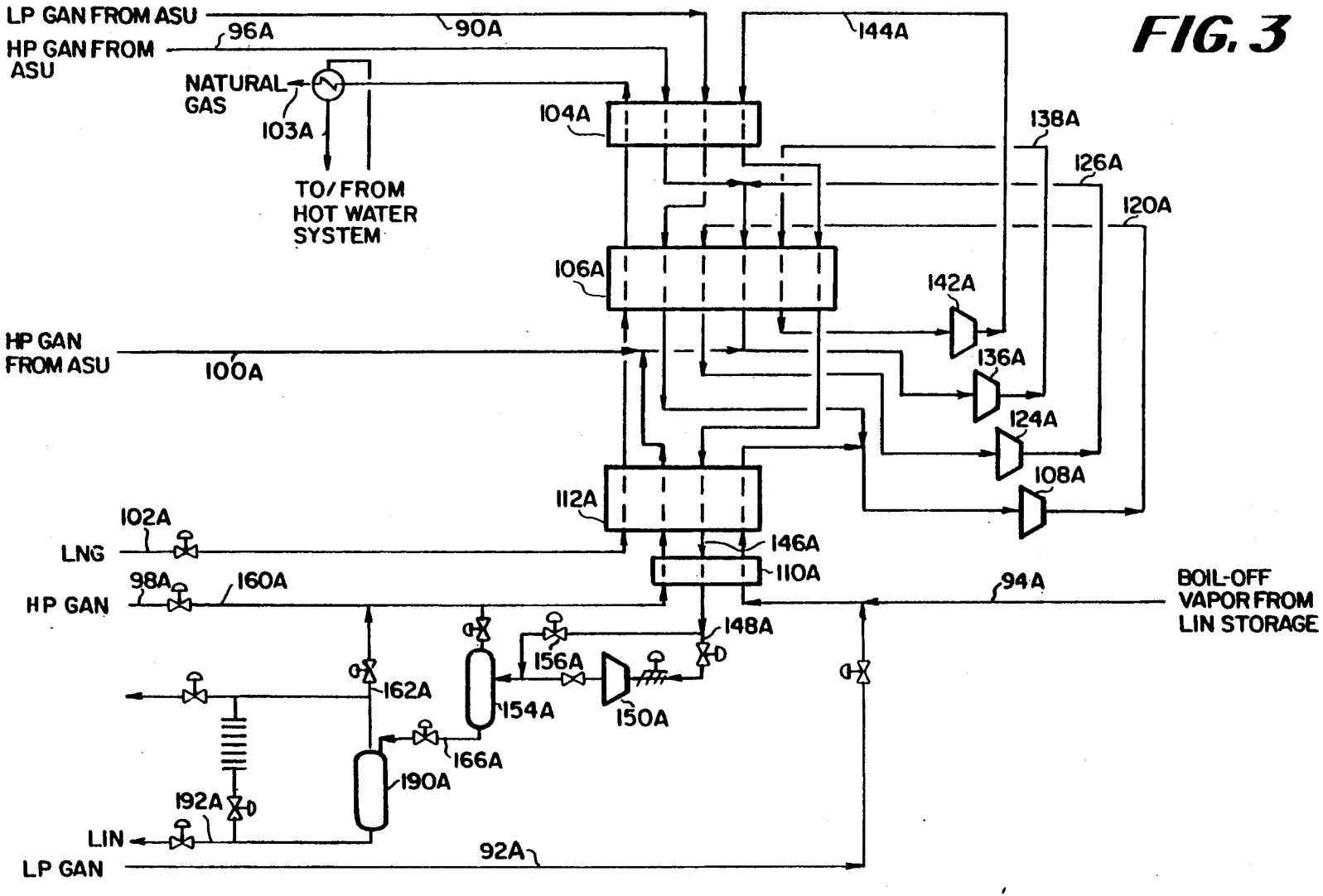
FIG. 3 is a specific flow diagram of another embodiment of the component liquefying process of the present invention which omits a reboiler/condenser means and reorders the internal passages of the main heat exchanger, such that no liquefiable air separation unit component stream with a pressure lower than that of the LNG refrigerant is in conduits operatively adjacent to the LNG stream.

Finally, with reference to FIG. 3, reboiler/condenser 188 of FIG. 2 may not be employed at all. Alternately, the passages in the heat exchangers 104A, 106A, 112A, and 110A could be arranged such that none of the gaseous nitrogen streams with a pressure lower than that of LNG are in the exchangers passages next to the LNG passages. This will reduce the heat transfer efficiency of these exchangers and possibly may require use of bigger heat exchangers. However, due to the proposed elimination of boiler/condenser 188 of FIG. 2, some savings in power will result. In FIG. 3, the liquid nitrogen from separator 154A is sent to another storage vessel 190A, which is about the same pressure as separator 154A. The liquid nitrogen stream 192A from separator 190A is sent back to the air separation unit for further handling.

In summary, the present invention is an improved process for the liquefaction of gases, such as nitrogen, using substantially all of the refrigeration available from a vaporizing LNG stream. Generally, the initial temperature of the vaporizing LNG should be lower than the critical temperature of the component to be liquefied, most commonly nitrogen.

The present invention has been described with reference to some specific embodiments thereof. These embodiments should not be considered a limitation of the scope of the present invention. The scope of the present invention is ascertained by the following claims.

We claim:

1. A process for the liquefaction of a nitrogen stream produced by a cryogenic air separation unit having at least one distillation column comprising:

(a) compressing the nitrogen stream to a pressure of at least 350 psi in a multi-stage compressor wherein interstage cooling is provided by heat exchange against vaporizing liquefied natural gas;

(b) condensing the compressed nitrogen stream by heat exchange against vaporizing liquefied natural gas;

(c) reducing the pressure of the condensed, compressed nitrogen stream thereby producing a two phase nitrogen stream;

(d) phase separating the two phase nitrogen stream into a liquid nitrogen stream and a nitrogen vapor stream; and (e) warming the nitrogen vapor stream to recover refrigeration.

2. The process of claim 1 which further comprises subcooling the condensed, compressed nitrogen stream of step (b) prior to reducing the pressure in step (c) by heat exchange against the warming nitrogen vapor stream of step (e).

3. The process of claim 1 which further comprises recycling the warmed nitrogen vapor stream of step (e) to an intermediate stage of the multi-stage compressor of step (a).

4. The process of claim 1 wherein the reduction in pressure of step (c) is accomplished by work expanding the condensed, compressed nitrogen stream in a dense fluid expander.

5. The process of claim 1 which further comprises subcooling the liquid nitrogen stream of step (d); reducing in pressure the subcooled liquid nitrogen stream thereby producing a second two phase nitrogen stream; phase separating the second two phase nitrogen stream into a second nitrogen vapor stream and a liquid nitrogen product stream.

6. The process of claim 5 which further comprises subcooling the liquid nitrogen stream of step (d) by heat exchange against the warming second nitrogen vapor stream.

7. The process of claim 1 which further comprises flashing a portion of the liquid nitrogen stream of step (d) and heat exchanging the flashed portion against a pressurized nitrogen stream thereby producing a quantity of liquid nitrogen which is free from hydrocarbon contamination and which is suitable to recycle to the air separation unit.

* * * * *